United States Patent [19]

Bishop et al.

[11] 4,261,869

[45] Apr. 14, 1981

[54] DETERGENT COMPOSITIONS

[75] Inventors: David P. Bishop; Robert T. Nelson, both of Wirral, England

[73] Assignee: Lever Brothers Company, New York, N.Y.

[21] Appl. No.: 43,205

[22] Filed: May 29, 1979

Related U.S. Application Data

[63] Continuation of Ser. No. 920,519, Jun. 29, 1978, abandoned.

[30] Foreign Application Priority Data

Jul. 1, 1977 [GB] United Kingdom ..... 27646/77

[51] Int. Cl.[3] ..... C11D 1/62; C11D 1/72; C11D 1/75; C11D 1/92

[52] U.S. Cl. ..... 252/542; 252/174.21; 252/526; 252/527; 252/528; 252/546; 252/547; 252/DIG. 1; 252/545

[58] Field of Search ..... 252/526, 527, 528, 545, 252/546, 547, 174.21, DIG. 1, 542

[56] References Cited

U.S. PATENT DOCUMENTS

| | | | |
|---|---|---|---|
| 3,351,557 | 11/1967 | Almstead | 252/106 |
| 3,537,993 | 11/1970 | Coward | 252/547 X |
| 3,660,286 | 5/1972 | Sepulveda | 252/547 X |
| 3,822,312 | 7/1974 | Sato | 252/527 |
| 3,843,563 | 10/1974 | Davies | 252/547 |
| 3,920,564 | 11/1975 | Grecsek | 252/8.25 |
| 3,983,079 | 9/1976 | Spadini | 252/545 |
| 4,065,409 | 12/1977 | Flanagan | 252/528 |

FOREIGN PATENT DOCUMENTS

| | | | |
|---|---|---|---|
| 1260584 | 1/1972 | United Kingdom | 252/8.8 |
| 1348212 | 3/1974 | United Kingdom | 252/545 |

*Primary Examiner*—Dennis L. Albrecht

*Attorney, Agent, or Firm*—James J. Farrell; Melvin H. Kurtz

[57] ABSTRACT

The incorporation of small amounts of cationic surfactant and zwitterionic or semipolar detergent in a polyoxyalkylene nonionic detergent suppresses dye transfer in the wash.

8 Claims, No Drawings

DETERGENT COMPOSITIONS

This application is a continuation of Ser. No. 920,519 filed June 29, 1978 and now abandoned.

This invention relates to detergent compositions suitable for washing fabrics.

White and colored garments are usually washed separately using different washing conditions and sometimes different detergent compositions. When they are washed together the results are often poor, either because there are used the mild conditions normally preferred for washing colored garments, and under these the white garments are washed poorly; or the washing conditions and the detergent composition are chosen to be suitable for washing white garments, and there is then often noticeable fading of the colored garments and transfer of dyes from them to the white garments. The increasing use of automatic washing machines accentuates the dye transfer problem.

This dye transfer problem is particularly serious when conventional anionic detergent compositions are used, but is also significant with nonionic detergent compositions, and there is a need for dye transfer suppression agents that can be used with nonionic detergents.

British Pat. No. 1,348,212 discloses that vinylpyrollidone polymers can be used to improve the dye transfer characteristics of nonionic detergents, including polyoxyalkylene nonionic detergents and semipolar nonionic detergents, such as amine oxides; and these nonionic detergents can be partly replaced by zwitterionic detergents, such as sulphobetaines.

It has now been found that sulphobetaines themselves improve the dye transfer characteristics of polyoxyalkylene nonionic detergents, but comparatively large amounts are necessary for effective suppression of dye transfer, and the use of such binary detergent compositions is made economically unattractive by the relatively high cost of the sulphobetaine required. However, it has been discovered that when small amounts of cationic surfactants are incorporated into mixtures containing polyoxyalkylene nonionic detergents and minor amounts of zwitterionic or semipolar detergents, the resulting ternary mixtures give unexpectedly low dye transfer. As the total amount of cationic surfactant and zwitterionic (or semipolar) detergent required to suppress dye transfer is less than when the cationic surfactant is absent, this discovery makes possible the more economic formulation of detergent compositions containing polyoxyalkylene nonionic detergents and zwitterionic detergents with improved dye transfer suppression properties.

Mixtures containing polyoxyalkylene nonionic detergents and minor amounts of cationic surfactants have been described in British Pat. No. 1,107,372 in relation to antistatic effects on textiles, but without reference to dye transfer suppression. While it has been found that small amounts of cationic surfactants reduce dye transfer with polyoxyalkylene nonionic detergents, the effect obtained is improved still further by the additon of minor amounts of zwitterionic or semipolar detergent-active compounds. Some compositions containing polyoxyalkylene nonionic detergents and cationic substances have already been described in the literature. Thus British Pat. No. 1,260,584 discloses fabric-softening compositions containing amine oxides and cationic fabric-softeners to which undesignated nonionic surfactants can be added in unstated amounts. U.S. Pat. No. 3,351,557 describes built liquid emulsions containing polyoxyalkylene nonionic detergents, and sulphobetaines or semipolar detergents such as amine oxides to which quaternary ammonium salts are added as germicides. These germicidal quaternary ammonium salts are employed in small amounts and are cationic surfactants. Thus it is stated that the emulsions can contain from about 1 to about 15%, preferably about 3 to about 12%, by weight of polyoxyalkylene nonionic detergent and from about 2 to about 10% of a sulphobetaine or amine oxide detergent, and from about 0.1 to about 0.5% of a quaternary ammonium salt as germicide. These amounts correspond to compositions containing from 8.7 to 87.7% of polyoxyalkylene nonionic detergent A, from 11.4 to 90% of zwitterionic or semipolar detergent B, and from 0.4 to 14.2% of cationic surfactant C, by weight of A,B and C together, with for preference from 22.2 to 83.1% of A, from 13.8 to 76.3% of B and from 0.45 to 9.1% of C. However, no solid detergent composition is disclosed and thee is no specific disclosure of any composition having less than 32.5% of B by weight of A,B and C. The disclosure is wholly silent as to dye transfer properties and is concerned with technical effects unrelated to them, namely emulsion stability effects peculiar to liquid compositions. A further disclosure of aqueous liquid compositions containing polyoxyalkylene nonionic detergents with zwitterionic detergents (carboxybetaines) and cationic substances is made in U.S. Pat. No. 3,822,312. The compositions concerned are for use in treating hair and are of no significance in relation to suppression of dye transfer in fabric washing. Calculation from the amounts disclosed shows that a minimum amount of 7.3% of cationic substance by weight of polyoxyalkylene detergent is to be employed.

According to the present invention a detergent composition comprises a polyoxyalkylene nonionic detergent A, a zwitterionic or semipolar detergent B, and a cationic surfactant C, in amounts of from 75 to 96% of A and from 1.0 to 24.5% of B by weight of the total of A,B and C, and from 0.5 to 6.75% of C by weight of A. Insofar as aqueous liquid compositions within these ranges overlap with a small part of the ranges disclosed in U.S. Pat. No. 3,351,557, such compositions represent a selection for an unobvious advantage, namely unexpected dye transfer suppression properties.

The co-operative effect of the cationic surfactant in suppressing the dye transfer may be due to the formation of complex micelles containing all three surfactants present, the cationic surfactant conferring additional positive charges which enable the micelles to compete with the fabric surface for anionic dye transferred from dyed fabric to the wash solution.

The effect is particularly strong when the amount of cationic surfactant C is from 2.0 to 5.5% by weight of the polyoxyalkylene nonionic detergent A, and also when the amount of zwitterionic or semipolar detergent B is from 1.5 to 20% by weight of the total of A,B and C, and especially when this amount is from 2 to 15%.

Polyoxyalkylene nonionic detergents A are a well-known class of detergent, many examples of which are described in Schick, *Nonionic Surfactants,* (Arnold), and in Schwartz, Perry and Berch, *Surface Active Agents and Detergents,* Volumes I and II (Interscience). Those detergents derived from ethylene oxide are of particular interest, but propylene oxide condensates can also be employed, and alkylene oxide condensates of aliphatic alcohols, alkyl phenols and fatty acid amides are included. Ethoxylated alcohols are preferably those derived from linear primary and secondary monohydric alcohols containing $C_8$ to $C_{20}$, and especially $C_{10}$ to $C_{15}$, alkyl groups, and containing from 5 to 25, preferably 7 to 20, ethenoxy units per molecule. Examples are the condensates of mixtures of linear secondary $C_{11}$ to $C_{15}$ alcohols with 9 moles of ethylene oxide, of tallow alcohol with 14 moles of ethylene oxide, and of mixtures of linear primary $C_{16}$ to $C_{20}$ alcohols with 15 or 18 moles of ethylene oxide. Ethoxylated alkylphenols with $C_6$ to $C_{16}$, and preferably $C_6$ to $C_9$ alkyl groups, and from 5 to 25, preferably 7 to 20 ethenoxy units per molecule, or ethoxylated fatty acid amides derived from fatty acids with from 8 to 18 and preferably 12 to 16 carbon atoms, and with from 5 to 25, preferably 7 to 20, ethenoxy units per molecule, can be employed. Mixtures of different polyoxyalkylene nonionic detergents can be employed.

Both zwitterionic and semipolar detergents B are well-known in the detergent art and are described in, for example, Schwartz, Perry and Berch. Where a zwitterionic detergent B is used, it is preferably a betaine, that is, a compound having a quaternary nitrogen atom, and a carboxylate or sulphonate head group, with a $C_8$ to $C_{22}$, preferably $C_{12}$ to $C_{18}$, alkyl group. Suitable carboxybetaines are ($C_{10}$–$C_{18}$)alkyl di($C_1$–$C_4$)-alkylammonium-($C_2$–$C_3$)alkane carboxylates, for example N-(tallow-alkyldimethylammonium)propionate. Preferably the zwitterionic detergent is a sulphobetaine, and suitable compounds are ($C_{10}$–$C_{18}$)alkyldi($C_1$–$C_4$)alkylammonium-($C_2$–$C_3$)alkyl or hydroxyalkyl sulphonates, for example 3-(hexadecyldimethylammonium)-propane-1-sulphonate, 3- and 4-pyridinium ($C_{10}$–$C_{18}$) alkane sulphonates, for instance 3- and 4-N-pyridinium-hexadecane-1-sulphonates, and 3- or 4-tri($C_1$–$C_4$)alkylammonium ($C_{10}$–$C_{18}$) alkane sulphonates, such as are described in British Pat. No. 1,277,200. Corresponding compounds in which, instead of the alkyl groups referred to, there are alkenyl or hydroxyalkyl groups, or analogous compounds containing amide or ester linkages, can also be employed. Zwitterionic detergents analogous to the carboxybetaines and sulphobetaines but containing sulphonium or phosphonium groups instead of quaternary nitrogen can be used.

Where a semipolar detergent B is employed, it is preferably an amine oxide. Amine oxide detergents include compounds of structure RR'R"NO, where R is a $C_{10}$ to $C_{22}$ alkyl or alkenyl group and R' and R" are $C_1$ to $C_4$ alkyl or $C_2$ to $C_3$ hydroxyalkyl groups. R is preferably a linear group and R' and R" are preferably identical, for example they are both methyl. Examples of suitable amine oxides are coconut alkyl dimethylamine and hardened tallow alkyl dimethylamine oxides. Analogous compounds which can be used are those in which R is a $C_8$ to $C_{18}$ alkyl benzyl group, for instance dodecylbenzyldimethylamine oxide, those in which R is a $C_8$ to $C_{22}$ acyloxy -ethyl or -propyl group, for example 3-(tallow acyl)propyldimethylamine oxide, and related compounds in which R' and R" form a heterocyclic ring, for example an N-alkylmorpholine oxide. Other suitable amine oxides are described in British Pat. No. 1,379,024. Other semipolar detergents that can be used are dialkyl sulphoxides and trialkylphosphine oxides, for example dodecylmethyl and 3-hydroxytridecylmethyl sulphoxides, and dodecyldimethyl and 2-hydroxydodecyldimethyl phosphine oxides.

Not only mixtures of different zwitterionic detergents or of different semipolar detergents, but mixtures of zwitterionic and semipolar detergents can be used as the detergent B.

Cationic surfactants C are also well-known in the detergent art: see for example Schwartz, Perry and Berch, and also Jungermann, *Cationic Surfactants* (Dekker, 1970). Cationic surfactants can be quaternary ammonium or phosphonium salts. Suitable quaternary ammonium salts are alkyl and alkylaryl quaternary ammonium salts and alkylpyridinium salts where the alkyl groups have from 8 to 22, and preferably from 12 to 18, carbon atoms. Examples of such compounds are alkyltrimethylammonium chlorides and bromides, for instance hexadecyltrimethylammonium bromide; and alkylbenzyldimethylammonium chlorides and bromides. Analogous compounds in which a longchain alkyl group is interrupted by an amide or ester linkage, or in which methyl groups are replaced by ethyl, propyl or hydroxyethyl groups can be used. An example of such a compound is 3-octadecanoyloxy-2-hydroxypropyltrimethylammonium chloride. Not only can there be used the more water-soluble cationic surfactants containing one long-chain hydrocarbon group, but there can be employed water-insoluble compounds with two such groups that are not regarded as detergents but are used as fabric-softening agents, especially di($C_8$–$C_{22}$)alkyldimethyl quaternary ammonium salts, for example di(coconut alkyl)dimethylammonium chloride, di(hardened tallow alkyl)dimethylammonium chloride, and analogous compounds such as di(laurylamidomethyl) di(hydroxyethyl)ammonium bromide and di(2-stearoyloxyethyl)-dimethylammonium chloride. Quaternary ammonium imidazoline fabric-softening compounds can be used. Preferably the cationic surfactant salt is a chloride or bromide, but other salts can be used, for instance sulphate, acetate, or methosulphate. Mixed cationic surfactants can be employed.

In addition to the detergents A and B and surfactant C, a detergent composition of the invention can comprise other detergent composition ingredients, for instance water and detergent adjuncts such as detergency builders. Preferably the detergent composition is a concentrate, as distinct from a dilute aqueous solution, that is, it contains from 0 to 30% by weight of water. The composition can consist of the detergents A and B and surfactant C without any adjunct, but where an adjunct is present, it can be used in major amounts. Thus the detergent composition can be a solid composition containing from 5 to 50% by weight of A,B and C and from 95 to 50% by weight of detergent adjuncts and water. A composition is preferably formulated to give a dilute aqueous solution of pH from 8 to 10.5. Although no builder is generally necessary for the three active ingredients to perform their function, the presence of such builders is useful in practice in order to avoid precipitation of fatty acids from soils, and alkaline detergency builders are useful to maintain alkaline conditions in the wash, which are essential where the detergent B only exhibits its zwitterionic or semipolar properties at a relatively high pH. Thus in order for an amine oxide to provide its function as a semipolar detergent it is necessary for the pH of the wash solution to be above 7, and an alkaline detergency builder in the composition ensures this. Suitable detergency builders are sodium tripolyphosphate, trisodium orthophosphate, sodium carbonate, and alkaline sodium silicate. Other detergency builders are descried in Schwartz, Perry and Berch. From 10 to 90% of detergency builder by weight of the composition it convenient, the proportion of builder by weight of A,B and C together preferably being within the range of from 0.2:1 to 10:1.

Other adjuncts that can be present in the compositions are those such as are normally used in fabric-washing detergent compositions, such as lather boosters, for example alkanolamides; lather depressants; anti-redeposition agents, for example sodium carboxymethylcellulose; bleaching agents, for example sodium perborate or percarbonate; peracid bleach precursors, chlorine-releasing bleaching agents, and inorganic salts, for example sodium sulphate. Colorants, perfumes, fluorescers, germicides and enzymes can also be present. Fluorescers tend to be more effective in the compositions than in corresponding compositions based on zwitterionic or mixed zwitterionic and polyoxyalkylene nonionic detergents alone.

Anionic detergents should be absent from the composition, as they form complexes with the cationic surfactant and effectively inactivate an equivalent amount.

The compositions of the invention can be prepared by admixture of the ingredients. Conventional processes for making detergent compositions can be used, or instance spray-drying of an aqueous slurry. The form of a composition will depend on the nature of the ingredients and their relative proportions. Thus where the polyoxyalkylene nonionic detergent is a liquid, the product may be a liquid or paste, or it may be a solid where sufficient amount of solid adjunct is present. Solid compositions can be produced in powder or bar form.

For washing fabrics the compositions are preferably used at relatively high concentrations, for instance as aqueous solutions containing 0.1% by weight of the total active ingredients A,B and C, and at temperatures of 40° to 50° C.

The invention is illustrated by the following Examples in which amounts are by weight unless otherwise indicated, temperatures are in ° C., and hardness is in °French hardness.

EXAMPLES 1 to 8

Detergent compositions are prepared by admixture of the following detergent-active compounds and sodium tripolyphosphate powder (D) in the amounts indicated in Table 1.

A. As polyoxyalkylene nonionic detergent a condensate of a mixture of linear secondary $C_{11}$ to $C_{15}$ alcohols with 9 moles of ethylene oxide.

B. As zwitterionic detergent 3-(hexadecyldimethylammonium) propane-1-sulphonate.

C. As cationic surfactant hexadecyltrimethylammonium bromide.

TABLE 1

| Example No. | 1 | 2 | 3 | 4 | 5 | 6 | 7 | 8 |
|---|---|---|---|---|---|---|---|---|
| A | 23.8 | 23.3 | 22.9 | 22.8 | 22.4 | 21.9 | 21.1 | 20.6 |
| B | 0.7 | 0.7 | 0.7 | 1.7 | 1.6 | 1.7 | 3.4 | 3.4 |

TABLE 1-continued

| Example No. | 1 | 2 | 3 | 4 | 5 | 6 | 7 | 8 |
|---|---|---|---|---|---|---|---|---|
| C | 0.5 | 1.0 | 1.4 | 0.5 | 1.0 | 1.4 | 0.5 | 1.0 |
| D | 75 | 75 | 75 | 75 | 75 | 75 | 75 | 75 |
| A/A+B+C % | 95.1 | 93.3 | 91.5 | 91.2 | 89.6 | 87.7 | 84.3 | 82.4 |
| B/A+B+C % | 2.9 | 2.9 | 2.8 | 6.9 | 6.4 | 6.6 | 13.7 | 13.6 |
| C/A % | 2.1 | 4.1 | 6.2 | 2.2 | 4.5 | 6.5 | 2.2 | 4.9 |

Dilute aqueous solutions in water of hardness 24° of these compositions were prepared. For comparative purposes dilute aqueous solutions of further compositions were prepared containing different amounts of the same ingredients outside the scope of the invention. Clean knitted cotton fabrics were washed for 10 min at 50° in a Tergotometer using a liquor to cloth ratio of 100:1 with agitation at 100 rpm with each dilute composition in which was dispersed 5 ppm of the Colour Index dyestuff Direct Red 81, a dye particularly susceptible to transfer in the wash. The light reflectances of the fabrics were measured before and after washing using a Zeiss Elrepho Reflectometer with a 530 nm filter and were obtained as $\Delta K/S$ values where K is the absorptivity coefficient and S the scattering coefficient, using the Kubelka-Munk relationship well-known in the detergent art. The $\Delta K/S$ value is proportional to the weight of dye taken up by the fabric. The results are shown in Table 2 as $1000 \times \Delta K/S$, in which for simplicity of presentation the amounts of C in each dilute solution are given in centigrams per liter and proportions of A to B are given, the amounts of A,B and C together always being 1 gram per liter, Examples being identified by numbers in parentheses.

TABLE 2

| A:B | C → | 0 | 2 | 4 | 6 | 8 | 10 |
|---|---|---|---|---|---|---|---|
| 10:0 | | 152 | 58 | 36 | 71 | 99 | 115 |
| 9.7:0.3 | | 102 | (1) 41 | (2) 22 | (3) 57 | 100 | 113 |
| 9.3:0.7 | | 77 | (4) 29 | (5) 18 | (6) 47 | 78 | 97 |
| 8.6:1.4 | | 22 | (7) 10 | (8) 8 | 41 | 73 | 89 |

The solutions of the Examples show reduced dye transfer relative to corresponding solutions containing (a) no B, (b) no C, and (c) amounts of C by weight of A greater than 6.75%.

EXAMPLES 9 to 35

Detergent compositions are prepared by admixture of a condensate of tallow alcohol with 14 moles of ethylene oxide as polyoxyalkylene nonionic detergent A, with the zwitterionic detergent B and cationic surfactant C as in Examples 1 to 8, and sodium tripolyphosphate powder (D) in the amounts in Table 3.

TABLE 3

| Example No. | 9 | 10 | 11 | 12 | 13 | 14 | 15 | 16 | 17 |
|---|---|---|---|---|---|---|---|---|---|
| A | 23.6 | 23.2 | 22.7 | 22.5 | 22.1 | 21.7 | 20.7 | 20.3 | 20.0 |
| B | 1.2 | 1.2 | 1.1 | 2.25 | 2.2 | 2.2 | 4.1 | 4.1 | 4.0 |
| C | 0.24 | 0.69 | 1.14 | 0.23 | 0.66 | 1.09 | 0.21 | 0.61 | 1.0 |
| C | 75 | 75 | 75 | 75 | 75 | 75 | 75 | 75 | 75 |
| A/A+B+C % | 94.3 | 92.4 | 90.9 | 90.0 | 88.5 | 86.9 | 82.6 | 81.3 | 80.0 |
| B/A+B+C % | 4.7 | 4.6 | 4.6 | 9.0 | 8.8 | 8.7 | 16.5 | 16.3 | 16.0 |
| C/A % | 1.0 | 3.0 | 5.0 | 1.0 | 3.0 | 5.0 | 1.0 | 3.0 | 5.0 |

Further compositions are prepared using the same quantities of ingredients as in Examples 9 to 17, but using as polyoxyalkylene nonionic detergent a condensate of a mixture of linear primary $C_{16}$ to $C_{20}$ alcohols with either 15 or 18 moles ethylene oxide (A' and A'' respectively).

Dilute aqueous solutions of these compositions and of other compositions for comparison were prepared and tested in the same way as for Examples 1 to 8, with results as $\Delta K/S \times 1000$ shown in Table 4, where Example Nos. are in parentheses. Here the amounts of B and C are given in centigrams per liter and the amount of A (A' or A'') is 1 gram per liter.

TABLE 4

| | B | C → | 0 | 1 | 3 | 5 | 10 | 20 |
|---|---|---|---|---|---|---|---|---|
| A | | 0 | 150 | 84 | 29 | 16 | 62 | 80 |
| | | 5 | 60 | (9)35 | (10)25 | (11)10 | 47 | 68 |
| | | 10 | 34 | (12)22 | (13)10 | (14) 8 | 39 | 84 |
| | | 20 | 8 | (15) 6 | (16) 4 | (17) 4 | 23 | 44 |
| A' | | 0 | 110 | 61 | 19 | 12 | 68 | 87 |
| | | 5 | 57 | (18)29 | (19)12 | (20) 8 | 48 | 67 |
| | | 10 | 24 | (21)14 | (22) 7 | (23) 7 | 40 | 60 |
| | | 20 | 8 | (24) 4 | (25) 3 | (26) 4 | 24 | 43 |
| A'' | | 0 | 144 | 74 | 27 | 17 | 84 | 102 |
| | | 5 | 69 | (27)37 | (28)16 | (29)11 | 59 | 78 |
| | | 10 | 30 | (30)18 | (31)10 | (32) 9 | 45 | 65 |
| | | 20 | 10 | (33) 7 | (34) 4 | (35) 6 | 37 | 65 |

The results show the compositions of the Example give reduced dye transfer as with Examples 1 to 8. The compositions of Examples 16,25 and 34 were also tested in the same way with nylon fabric instead of cotton and similar results were obtained.

EXAMPLES 36 to 38

Detergent compositions are prepared by admixture of the polyoxyalkylene nonionic detergent A and zwitterionic detergent B of Examples 1 to 8 with as cationic surfactant C 3-octadecanoyloxy-2-hydroxypropyltrimethylammonium chloride and sodium tripolyphosphate (D), in amounts in Table 5.

TABLE 5

| Example No. | 36 | 37 | 38 |
|---|---|---|---|
| A | 21.3 | 20.9 | 20.5 |
| B | 3.5 | 3.4 | 3.3 |
| C | 0.25 | 0.73 | 1.19 |
| D | 75 | 75 | 75 |
| A/A+B+C % | 85.2 | 83.5 | 81.9 |
| B/A+B+C % | 13.8 | 13.6 | 13.4 |
| C/A % | 1.2 | 3.5 | 5.81 |

Dilute aqueous solutions of these compositions and of other compositions for comparison were prepared and tested in the same way as for Examples 1 to 8, with results as in Table 6.

TABLE 6

| Example No. | | 36 | 37 | 38 | | | |
|---|---|---|---|---|---|---|---|
| A:B | C → 0 | 1 | 3 | 5 | 7 | 9 | 15 |
| 8.6:1.4 | 25 | 21 | 15 | 13 | 23 | 41 | 80 |

EXAMPLES 39 to 43

Detergent compositions are prepared by admixture of the polyoxyalkylene nonionic detergent A of Examples 1 to 8, with as zwitterionic detergent B 3-(N-pyridinium)hexadecane-1-sulphonate and as cationic surfactant C di(hardened tallow alkyl)dimethylammonium chloride, with sodium tripolyphosphate (D), in the amounts of Table 7.

TABLE 7

| Example No. | 39 | 40 | 41 | 42 | 43 |
|---|---|---|---|---|---|
| A | 23.15 | 22.1 | 21.2 | 20.3 | 18.8 |
| B | 1.15 | 2.2 | 3.2 | 4.1 | 5.65 |
| C | 0.69 | 0.66 | 0.64 | 0.61 | 0.56 |
| D | 75 | 75 | 75 | 75 | 75 |
| A/A+B+C % | 92.6 | 88.5 | 84.7 | 81.3 | 75.2 |
| B/A+B+C % | 4.6 | 8.9 | 12.8 | 16.3 | 22.6 |
| C/A % | 3.0 | 3.0 | 3.0 | 3.0 | 3.0 |

Dilute aqueous solutions of these compositions were prepared containing 1 gram per liter of nonionic detergent A and, together with a solution containing the same amount of A, 0.3 grams per liter of C but no C, were submitted to the same tests for dye uptake as in Examples 1 to 8 both for cotton and for nylon. The detergency of the slutions was measured by a standard test in which the same conditions were used for washing dirty motor oil stains from a standard soiled test cloth. The soil redeposition properties of each solution were also determined by measuring reflectance using an Elrepho Reflectometer with a 460 nm filter before and after washing under the same conditions the test fabric in the presence of a standard mixed vacuum cleaner dust and synthetic sebum, and expressing the result as $\Delta K/S$. The results were as in Table 8.

TABLE 8

| Example No. | | 39 | 40 | 41 | 42 | 43 |
|---|---|---|---|---|---|---|
| C cg/liter | 0 | 5 | 10 | 15 | 20 | 30 |
| Dye uptake $\Delta K/S \times 1000$ | | | | | | |
| Cotton | 87 | 43 | 28 | 22 | 12 | 8 |
| Nylon | 53 | 35 | 28 | 23 | 17 | 13 |
| Detergency % | | | | | | |
| Cotton | 93 | 91 | 91 | 91 | 91 | 90 |
| Nylon | 59 | 72 | 80 | 80 | 73 | 82 |
| Soil redeposition $\Delta K/S \times 1000$ | | | | | | |
| Cotton | 3 | 3 | 3 | 3 | 3 | 2 |
| Nylon | 2 | 2 | 2 | 2 | 3 | 2 |

These results show that suppression of dye transfer is not achieved at the expense of poor fabric washing properties as shown by loss of detergency or increased soil redeposition.

EXAMPLES 44 to 67

Detergent compositions are prepared by admixture of the polyoxyalkylene nonionic detergent A and cationic surfactant C of Examples 1 to 8 with as semipolar detergent coconut-alkyldimethylamine oxide B and sodium tripolyphosphate powder (D), in amounts shown in Table 9, with the amine oxide present as a 40% aqueous solution.

TABLE 9

| Example No. | 44 | 45 | 46 | 47 | 48 | 49 | 50 | 51 |
|---|---|---|---|---|---|---|---|---|
| A | 23.6 | 23.15 | 22.7 | 21.6 | 21.2 | 20.8 | 19.1 | 18.8 |
| B | 1.2 | 1.15 | 1.15 | 3.2 | 3.2 | 3.1 | 5.7 | 5.6 |
| C | 0.24 | 0.69 | 1.14 | 0.22 | 0.64 | 1.04 | 0.19 | 0.56 |
| D | 75 | 75 | 75 | 75 | 75 | 75 | 75 | 75 |
| A/A+B+C % | 94.3 | 92.4 | 90.9 | 86.2 | 84.7 | 83.3 | 76.3 | 75.2 |
| B/A+B+C % | 4.7 | 4.6 | 4.6 | 12.9 | 12.7 | 12.5 | 22.0 | 22.6 |
| C/A % | 1.0 | 3.0 | 5.0 | 1.0 | 3.0 | 5.0 | 1.0 | 3.0 |

Further compositions are prepared using the same quantities of ingredients as in Examples 44 to 51, but using as semipolar detergent either (hardened tallow alkyl)dimethylamine oxide (B') or 3-(tallow acylamido)-propyldimethylamine oxide (B").

Dilute aqueous solutions of these compositions and of other compositions were prepared, all containing 1 gram per liter of nonionic detergent A, and tested in the same way as for Examples 1 to 8, with results as $\Delta K/S \times 1000$ shown in Table 10, where the amounts of B,B',B" and C are given in centigrams per liter, and Examples identified by numbers in parentheses.

TABLE 10

| | C → | 0 | 1 | 3 | 5 | 10 | 20 |
|---|---|---|---|---|---|---|---|
| B | 0 | 125 | 73 | 30 | 51 | 99 | 104 |
| | 5 | 109 | (44)65 | (45)27 | (46)37 | 96 | 105 |
| | 15 | 69 | (47)39 | (48)19 | (49)22 | 74 | 87 |
| | 30 | 35 | (50)22 | (51)13 | 11 | 57 | 79 |
| B' | 5 | 88 | (52)54 | (53)23 | (54)43 | 88 | 93 |
| | 15 | 37 | (55)24 | (56)13 | (57)26 | 84 | 99 |
| | 30 | 16 | (58)11 | (59) 7 | 20 | 66 | 90 |
| B" | 5 | 114 | (60)67 | (61)28 | (62)40 | 97 | 94 |
| | 15 | 68 | (63)44 | (64)19 | (65)19 | 28 | 89 |
| | 30 | 50 | (66)32 | (67)17 | 11 | 49 | 68 |

EXAMPLES 68 to 70

Detergent compositions are prepared by admixture of the nonionic detergent A, zwitterionic detergent B and cationic surfactant C of Examples 1 to 8, with and without detergency builders in amounts as in Table 11.

TABLE 11

| Example No. | 68 | 69 | 70 |
|---|---|---|---|
| A | 83.5 | 20.9 | 20.9 |
| B | 13.6 | 3.4 | 3.4 |
| C | 3.0 | 0.7 | 0.7 |
| Sodium tripolyphosphate | 0 | 75 | 70 |
| 50% aqueous alkaline sodium silicate solution | 0 | 0 | 10 |

Dilute aqueous solutions of these compositions containing 0.86 grams per liter of A were tested in the same way as for Examples 1 to 8 except that different washing temperatures and water of different hardness were employed, and tests were carried out on nylon as well as cotton, with the results shown in Table 12, the pH of washing also being determined.

TABLE 12

| Composition | pH | Temperature °C. | Hardness °H | $\Delta K/S \times 1000$ Cotton | Nylon |
|---|---|---|---|---|---|
| Example 68 | 7.5 | 35 | 0 | 1 | 13 |
| | 7.3 | 50 | 0 | 2 | 17 |
| | 6.6 | 70 | 0 | 1 | 26 |
| Example 69 | 9.3 | 35 | 0 | 2 | 5 |
| | 8.6 | 35 | 24 | 4 | 9 |
| | 9.3 | 50 | 0 | 4 | 5 |
| | 8.7 | 50 | 24 | 9 | 7 |
| | 9.1 | 70 | 0 | 14 | 5 |
| | 8.7 | 70 | 24 | 21 | 13 |
| Example 70 | 10.1 | 35 | 0 | 2 | 4 |
| | 9.5 | 35 | 24 | 5 | 7 |
| | 9.9 | 50 | 0 | 5 | 4 |
| | 9.4 | 50 | 24 | 10 | 6 |
| | 9.6 | 70 | 0 | 19 | 2 |
| | 9.3 | 70 | 24 | 30 | 11 |

By comparison with results obtained with detergent compositions containing only polyoxyalkylene nonionic detergent these results indicate that the low dye transfer properties of the compositions of the Examples are less influenced by temperature, pH and hardness of wash water, especially with high temperature, when the dye transfer problem with polyoxyalkylene nonionic detergents is greatest.

EXAMPLE 71

Dilute aqueous solutions of the detergent composition of Example 35 of various concentrations were prepared and tested as described for Examples 1 to 8, with results as in Table 13.

TABLE 13

| Concentration of composition in grams per liter | 0 | 0.32 | 1.88 | 6.24 | 7.52 | 12.48 |
|---|---|---|---|---|---|---|
| $\Delta \frac{K}{S} \times 1000$ (cotton) | 500 | 195 | 12 | 5 | 4 | 3 |

EXAMPLES 72 to 74

Detergent compositions are prepared from the zwitterionic detergent 3-(hexadecyldimethylammonium)-propane sulphonate B, the cationic surfactant 3-octadecanoyloxy-2-hydroxypropyltrimethylammonium chloride C and three different polyoxyalkylene nonionic detergents, condensation products of a mixture of linear secondary $C_{11}$ to $C_{15}$ alcohols with 9 moles ethylene oxide (A), of a mixture of linear primary $C_{16}$ to $C_{20}$ alcohols with 15 moles ethylene oxide (A'), and of tallow alcohol with 14 moles ethylene oxide (A"), together with sodium tripolyphosphate (D). The amounts employed are 21 parts A,A' or A", 3 parts B, 1 part C and 75 parts D.

The detergencies of dilute aqueous solutions in water of 24° containing 4.2 grams per liter of the three compositions were measured with standard test cloths of three different fibres soiled with dirty motor oil in a Tergotometer with 100 rpm agitation, using a liquor to cloth ratio of 100:1 and a 10 minute wash at 50°. Similar tests were carried out the aqueous solutions containing 4.2 grams per liter of the polyoxyalkylene nonionic detergents alone for comparison. The results of the tests using the composition containing the nonionic detergent A (Example 72) are given in Table 14.

TABLE 14

| | Detergency % Cotton | Nylon | Polyester |
|---|---|---|---|
| Composition of Example 72 | 91 | 82 | 21 |
| Composition with no B or C | 91 | 63 | 18 |

These results indicate no loss of detergency on inclusion of B and C, and similar results were obtained with compositions containing A' (Example 73) and A" (Example 74).

EXAMPLES 75 to 77

Solid detergent compositions are prepared from a condensation product of a mixture of linear secondary $C_{11}$ to $C_{15}$ alcohol: with 9 moles ethylene oxide A, 3-(hexadecyldimethylammonium) propane-1-sulphonate B, and either hexadecyltrimethylammonium bromide (C) or 3-octadecanoyloxy-2-hydroxypropylammonium chloride (C'), and adjuncts, in the amounts in Table 15.

TABLE 15

| Example No. | 75 | 76 | 77 |
|---|---|---|---|
| A | 17.8 | 18.6 | 16.4 |
| B | 1.4 | 0.6 | 2.6 |
| C | 0.8 | 0.8 | |
| C' | | | 1.0 |
| Sodium tripolyphosphate | 40 | 40 | 40 |
| Sodium sulphate | 39.5 | 39.5 | 39.5 |
| Fluorescer | 0.5 | 0.5 | 0.5 |

Dilute aqueous solutions containing 5 grams per liter in water of harndess 24° of each composition were prepared and tested for dye transfer properties using 8 standard fabrics with different dyes in conjunction with one white cotton and one white nylon fabric at 55° for 30 minutes. Similar washes were carried out with a similarly formulated composition containing A as the sole detergent and also with a similarly formulated composition containing sodium dodecylbenzene sulphonate as the sole detergent. The dye uptake of the white fabrics was measured and the results added to give total dye transfer. The results are given in Table 16.

TABLE 16

| Composition | Dye transfer value |
|---|---|
| Sodium dodecylbenzene sulphonate | 100 |
| Nonionic detergent A alone | 75.5 |
| Example 75 | 63 |
| Example 76 | 69 |
| Example 77 | 71.5 |

EXAMPLE 78

A solid detergent composition was prepared by admixture of the ingredients of Table 17.

TABLE 17

| | |
|---|---|
| The polyoxyalkylene nonionic detergent of Examples 75–77 | 11.3 |
| 4-(N-Pyridinium)hexadecane-2-sulphonate | 2.7 |
| Hexadecyltrimethylammonium bromide | 0.4 |
| Sodium tripolyphosphate | 40 |
| Sodium sulphate | 10 |
| 50% Aqueous alkaline sodium silicate solution | 10 |
| Sodium perborate | 30 |
| Fluorescer | 0.6 |

This composition was used at concentrations of 2,4 and 6 grams per liter, at temperatures from 40° to 85° and at times from 2 to 20 minutes to wash a total of 75 domestically soiled loads of mixed coloured and white garments, together with clean white cotton and nylon test cloths, and the incidence of staining (numbers of garments showing any staining) by dye transfer assessed visually with scoring of the intensity of staining. For comparison similar procedures were carried out using two commercial fabric washing powders based respectively on the same polyoxyalkylene nonionic detergent as sole active detergent, and on a sodium dodecylbenzene sulphonate detergent. The aggregated scores obtained were as in Table 18.

TABLE 18

| | Stain intensity | | Incidence of staining % | |
|---|---|---|---|---|
| Composition | Cotton | Nylon | Cotton | Nylon |
| Example 78 | 28 | 115 | 8 | 30 |
| Nonionic detergent alone | 35 | 114 | 12 | 34 |
| Sodium dodecylbenzene sulphonate detergent | 58 | 184 | 13 | 39 |

In those washes conducted at above 60° the total incidence of staining for cotton and nylon combined were respectively 44% of the composition of Example 78 and 55% and 63% for the comparative compositions.

We claim:

1. A solid detergent composition comprising:

(i) a polyoxyalkylene nonionic detergent A in the form of an alkyleneoxide condensate of an aliphatic alcohol;

(ii) a sulpho-betaine zwitterionic detergent B; and (iii) a cationic surfactant C, in the amounts of from 75% to 89.6% of A and from 6.4% to 24.5% of B by weight based on the total weight of A, B and C, and from 0.5% to 5.81% of C by weight based on the weight of A.

2. A composition according to claim 1, in which the amount of B is from 6.4% to 20% by weight based on the weight of A, B and C.

3. A composition according to claim 2, in which the amount of B is from 6.4% to 15% by weight based on the weight of A, B and C.

4. A composition according to claim 1, in which the amount of C is from 2.0% to 5.5% by weight based on the weight of A.

5. A composition according to claim 1, further containing from 0 to 30% by weight of water based on the weight of the composition.

6. A composition according to claim 1, further containing from 10% to 90% by weight of detergency builder based on the weight of the composition.

7. A composition according to claim 1, in which the polyoxyalkylene nonionic detergent A is an ethoxylated linear primary or secondary monohydric alcohol containing an alkyl group having from 8 to 20 carbon atoms and containing from 7 to 20 ethenoxy units per molecule.

8. A composition according to claim 1, in which the cationic surfactant C is a quaternary ammonium salt.

* * * * *